US008760251B2

(12) United States Patent
Roberts et al.

(10) Patent No.: US 8,760,251 B2
(45) Date of Patent: Jun. 24, 2014

(54) SYSTEM AND METHOD FOR PRODUCING STACKED FIELD EMISSION STRUCTURES

(75) Inventors: Mark D. Roberts, Huntsville, AL (US); Larry W. Fullerton, New Hope, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 105 days.

(21) Appl. No.: 13/246,584

(22) Filed: Sep. 27, 2011

(65) Prior Publication Data

US 2012/0092103 A1 Apr. 19, 2012

Related U.S. Application Data

(60) Provisional application No. 61/404,147, filed on Sep. 27, 2010.

(51) Int. Cl.
*H01F 7/02* (2006.01)
*H01H 9/00* (2006.01)

(52) U.S. Cl.
USPC ..... 335/306; 335/207

(58) Field of Classification Search
USPC ..... 335/207, 306
See application file for complete search history.

(56) References Cited

U.S. PATENT DOCUMENTS

| | | | |
|---|---|---|---|
| 381,968 | A | 5/1888 | Tesla |
| 493,858 | A | 3/1893 | Edison |
| 687,292 | A | 11/1901 | Armstrong |
| 996,933 | A | 7/1911 | Lindquist |
| 1,171,351 | A | 2/1916 | Neuland |
| 1,236,234 | A | 8/1917 | Troje |
| 2,243,555 | A | 5/1941 | Faus |
| 2,389,298 | A | 11/1945 | Ellis |
| 2,438,231 | A | 3/1948 | Shultz |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

Series BNS, Compatible Series AES Safety Controllers, http://www.schmersalusa.com/safety_controllers/drawings/aes.pdf, pp. 159-175, date unknown.

(Continued)

*Primary Examiner* — Alexander Talpalatski
(74) *Attorney, Agent, or Firm* — Venable LLP; Robert S. Babayi

(57) ABSTRACT

A stacked field emission system having an outer surface includes at least three field emission structure layers having a stacked relationship that defines a field characteristic of the outer surface. The mechanisms holds the at least three field emission structure layers such that a plurality of interface surfaces of the at least three field emission structure layers correspond to a plurality of interface boundaries between adjacent field emission structure layers. Each of the at least three field emission structure layers includes a plurality of field emission sources having positions, polarities, and field strengths in accordance with a spatial force function that corresponds to a relative alignment of the at least three field emission structures layers in the stacked relationship. A movement of at least one of the at least three field emission structures varies the field characteristics of the outer surface.

9 Claims, 12 Drawing Sheets

(56) References Cited

U.S. PATENT DOCUMENTS 2,471,634 A 5/1949 Vennice
2,570,625 A 10/1951 Zimmerman et al.
2,722,617 A 11/1955 Cluwen et al.
3,055,999 A 9/1962 Lucas
3,102,314 A 9/1963 Alderfer
3,208,296 A 9/1965 Baermann
3,238,399 A 3/1966 Johanees et al.
3,288,511 A 11/1966 Tavano
3,301,091 A 1/1967 Reese
3,382,386 A 5/1968 Schlaeppi
3,408,104 A 10/1968 Raynes
2,932,545 A 4/1969 Foley
3,468,576 A 9/1969 Beyer et al.
3,474,366 A 10/1969 Barney
3,521,216 A 7/1970 Tolegian
3,645,650 A 2/1972 Laing
3,668,670 A 6/1972 Andersen
3,684,992 A 8/1972 Huguet et al.
3,696,258 A 10/1972 Anderson et al.
3,790,197 A 2/1974 Parker
3,791,309 A 2/1974 Baermann
3,802,034 A 4/1974 Bookless
3,803,433 A 4/1974 Ingenito
3,808,577 A 4/1974 Mathauser
3,845,430 A 10/1974 Petkewicz et al.
3,893,059 A 7/1975 Nowak
4,079,558 A 3/1978 Forham
4,117,431 A 9/1978 Eicher
4,129,846 A 12/1978 Yablochnikov
4,209,905 A 7/1980 Gillings
4,222,489 A 9/1980 Hutter
4,296,394 A 10/1981 Ragheb
4,352,960 A 10/1982 Dormer et al.
4,355,236 A * 10/1982 Holsinger ..... 250/396 ML
4,399,595 A 8/1983 Yoon et al.
4,416,127 A 11/1983 Gomez-Olea Naveda
4,453,294 A 6/1984 Morita
4,535,278 A 8/1985 Asakawa
4,547,756 A 10/1985 Miller et al.
4,629,131 A 12/1986 Podell
4,645,283 A 2/1987 MacDonald et al.
4,680,494 A 7/1987 Grosjean
4,764,743 A * 8/1988 Leupold et al. ..... 335/306
4,837,539 A 6/1989 Baker
4,849,749 A 7/1989 Fukamachi et al.
4,862,128 A * 8/1989 Leupold ..... 335/306
H0693 H * 10/1989 Leupold ..... 505/213
4,893,103 A * 1/1990 Leupold ..... 505/213
4,912,727 A 3/1990 Schubert
4,941,236 A 7/1990 Sherman et al.
4,956,625 A 9/1990 Cardone et al.
4,993,950 A 2/1991 Mensor, Jr.
4,994,778 A * 2/1991 Leupold ..... 335/306
4,996,457 A 2/1991 Hawsey et al.
5,013,949 A 5/1991 Mabe, Jr.
5,020,625 A 6/1991 Yamauchi et al.
5,050,276 A 9/1991 Pemberton
5,062,855 A 11/1991 Rincoe
5,123,843 A 6/1992 Van der Zel et al.
5,179,307 A 1/1993 Porter
5,213,307 A * 5/1993 Perrillat-Amede ..... 251/65
5,302,929 A 4/1994 Kovacs
5,309,680 A 5/1994 Kiel
5,345,207 A 9/1994 Gebele
5,367,891 A 11/1994 Furuyama
5,383,049 A 1/1995 Carr
5,394,132 A 2/1995 Poil
5,399,933 A * 3/1995 Tsai ..... 313/431
5,425,763 A 6/1995 Stemmann
5,440,997 A 8/1995 Crowley
5,461,386 A 10/1995 Knebelkamp
5,492,572 A 2/1996 Schroeder et al.
5,495,221 A 2/1996 Post
5,512,732 A 4/1996 Yagnik et al.
5,570,084 A 10/1996 Ritter et al.
5,582,522 A 12/1996 Johnson
5,604,960 A 2/1997 Good
5,631,093 A 5/1997 Perry et al.
5,631,618 A 5/1997 Trumper et al.
5,633,555 A 5/1997 Ackermann et al.
5,635,889 A 6/1997 Stelter
5,637,972 A 6/1997 Randall et al.
5,730,155 A 3/1998 Allen
5,742,036 A 4/1998 Schramm, Jr. et al.
5,759,054 A 6/1998 Spadafore
5,788,493 A 8/1998 Tanaka et al.
5,852,393 A 12/1998 Reznik et al.
5,935,155 A 8/1999 Humayun et al.
5,956,778 A 9/1999 Godoy
5,983,406 A 11/1999 Meyerrose
6,039,759 A 3/2000 Carpentier et al.
6,047,456 A 4/2000 Yao et al.
6,072,251 A 6/2000 Markle
6,074,420 A 6/2000 Eaton
6,115,849 A 9/2000 Meyerrose
6,118,271 A 9/2000 Ely et al.
6,120,283 A 9/2000 Cousins
6,142,779 A 11/2000 Siegel et al.
6,170,131 B1 1/2001 Shin
6,187,041 B1 2/2001 Garonzik
6,205,012 B1 3/2001 Lear
6,210,033 B1 4/2001 Karkos, Jr. et al.
6,224,374 B1 5/2001 Mayo
6,234,833 B1 5/2001 Tsai et al.
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,457,179 B1 10/2002 Prendergast
6,467,326 B1 10/2002 Garrigus
6,535,092 B1 * 3/2003 Hurley et al. ..... 335/306
6,540,515 B1 4/2003 Tanaka
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 * 3/2005 Perrin ..... 335/306
6,913,471 B2 7/2005 Smith
6,927,657 B1 8/2005 Wu
6,954,938 B2 10/2005 Emberty et al.
6,954,968 B1 10/2005 Sitbon
6,971,147 B2 12/2005 Halstead
7,016,492 B2 3/2006 Pan et al.
7,031,160 B2 4/2006 Tillotson
7,033,400 B2 4/2006 Currier
7,038,565 B1 * 5/2006 Chell ..... 335/229
7,065,860 B2 6/2006 Aoki et al.
7,066,739 B2 6/2006 McLeish
7,066,778 B2 6/2006 Kretzschmar
7,101,374 B2 9/2006 Hyde, Jr.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,339,790 B2 3/2008 Baker et al.
7,362,018 B1 4/2008 Kulogo et al.
7,381,181 B2 6/2008 Lau et al.
7,402,175 B2 7/2008 Azar
7,438,726 B2 10/2008 Erb
7,444,683 B2 11/2008 Prendergast et al.
7,453,341 B1 11/2008 Hildenbrand
7,498,914 B2 3/2009 Miyashita et al.
7,583,500 B2 9/2009 Ligtenberg et al.
7,715,890 B2 * 5/2010 Kim et al. ..... 455/575.4
7,775,567 B2 8/2010 Ligtenberg et al.
7,796,002 B2 9/2010 Hashimoto et al.
7,808,349 B2 10/2010 Fullerton et al.

(56) References Cited

U.S. PATENT DOCUMENTS

| | | | | |
|---|---|---|---|---|
| 7,812,697 | B2 | 10/2010 | Fullerton et al. | |
| 7,817,004 | B2 | 10/2010 | Fullerton et al. | |
| 7,832,897 | B2 | 11/2010 | Ku | |
| 7,837,032 | B2 | 11/2010 | Smeltzer | |
| 7,839,246 | B2 | 11/2010 | Fullerton et al. | |
| 7,843,297 | B2 | 11/2010 | Fullerton et al. | |
| 7,868,721 | B2 | 1/2011 | Fullerton et al. | |
| 7,874,856 | B1 | 1/2011 | Schriefer et al. | |
| 7,889,037 | B2 * | 2/2011 | Cho | 335/306 |
| 7,903,397 | B2 | 3/2011 | McCoy | |
| 7,905,626 | B2 | 3/2011 | Shantha et al. | |
| 8,002,585 | B2 | 8/2011 | Zhou | |
| 8,099,964 | B2 * | 1/2012 | Saito et al. | 62/3.1 |
| 2002/0125977 | A1 | 9/2002 | VanZoest | |
| 2003/0170976 | A1 | 9/2003 | Molla et al. | |
| 2003/0179880 | A1 | 9/2003 | Pan et al. | |
| 2003/0187510 | A1 | 10/2003 | Hyde | |
| 2004/0003487 | A1 | 1/2004 | Reiter | |
| 2004/0155748 | A1 | 8/2004 | Steingroever | |
| 2004/0244636 | A1 | 12/2004 | Meadow et al. | |
| 2004/0251759 | A1 | 12/2004 | Hirzel | |
| 2005/0102802 | A1 | 5/2005 | Sitbon et al. | |
| 2005/0196484 | A1 | 9/2005 | Khoshnevis | |
| 2005/0231046 | A1 | 10/2005 | Aoshima | |
| 2005/0240263 | A1 | 10/2005 | Fogarty et al. | |
| 2005/0263549 | A1 | 12/2005 | Scheiner | |
| 2005/0283839 | A1 | 12/2005 | Cowburn | |
| 2006/0066428 | A1 | 3/2006 | McCarthy et al. | |
| 2006/0189259 | A1 | 8/2006 | Park et al. | |
| 2006/0198047 | A1 | 9/2006 | Xue et al. | |
| 2006/0214756 | A1 | 9/2006 | Elliott et al. | |
| 2006/0290451 | A1 | 12/2006 | Prendergast et al. | |
| 2006/0293762 | A1 | 12/2006 | Schulman et al. | |
| 2007/0072476 | A1 | 3/2007 | Milan | |
| 2007/0075594 | A1 | 4/2007 | Sadler | |
| 2007/0103266 | A1 | 5/2007 | Wang et al. | |
| 2007/0138806 | A1 | 6/2007 | Ligtenberg et al. | |
| 2007/0255400 | A1 | 11/2007 | Parravicini et al. | |
| 2008/0119250 | A1 * | 5/2008 | Cho et al. | 455/575.4 |
| 2008/0139261 | A1 | 6/2008 | Cho et al. | |
| 2008/0174392 | A1 * | 7/2008 | Cho | 335/285 |
| 2008/0181804 | A1 | 7/2008 | Tanigawa et al. | |
| 2008/0186683 | A1 | 8/2008 | Ligtenberg et al. | |
| 2008/0218299 | A1 | 9/2008 | Arnold | |
| 2008/0224806 | A1 | 9/2008 | Ogden et al. | |
| 2008/0272868 | A1 | 11/2008 | Prendergast et al. | |
| 2008/0282517 | A1 | 11/2008 | Claro | |
| 2009/0021333 | A1 | 1/2009 | Fiedler | |
| 2009/0209173 | A1 | 8/2009 | Arledge et al. | |
| 2009/0250576 | A1 | 10/2009 | Fullerton et al. | |
| 2009/0251256 | A1 | 10/2009 | Fullerton et al. | |
| 2009/0254196 | A1 | 10/2009 | Cox et al. | |
| 2009/0278642 | A1 | 11/2009 | Fullerton et al. | |
| 2009/0289090 | A1 | 11/2009 | Fullerton et al. | |
| 2009/0289749 | A1 | 11/2009 | Fullerton et al. | |
| 2009/0292371 | A1 | 11/2009 | Fullerton et al. | |
| 2010/0033280 | A1 | 2/2010 | Bird et al. | |
| 2010/0126857 | A1 | 5/2010 | Polwart et al. | |
| 2010/0167576 | A1 | 7/2010 | Zhou | |
| 2011/0026203 | A1 | 2/2011 | Ligtenberg et al. | |
| 2011/0210636 | A1 | 9/2011 | Kuhlmann-Wilsdorf | |
| 2011/0234344 | A1 | 9/2011 | Fullerton et al. | |
| 2011/0248806 | A1 | 10/2011 | Michael | |
| 2011/0279206 | A1 | 11/2011 | Fullerton et al. | |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | | 1/1938 |
| GB | 1 495 677 | A | 12/1977 |
| JP | S57-55908 | U | 4/1982 |
| JP | S57-189423 | U | 12/1982 |
| JP | 60-091011 | U | 5/1985 |
| JP | 60-221238 | A | 11/1985 |
| JP | 2001-328483 | A | 11/2001 |
| JP | 05-038123 | B2 | 10/2012 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

BNS 33 Range, Magnetic safety sensors, Rectangular design, http://www.farnell.com/datasheets/36449.pdf, 3 pages, date unknown.

Series BNS-B20, Coded-Magnet Sensor Safety Door Handle, http://www.schmersalusa.com/catalog_pdfs/BNS_B20.pdf, 2 pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Wikipedia, "Barker Code", Web article, last modified Aug. 2, 2008, 2 pages.

Wikipedia, "Kasami Code", Web article, last modified Jun. 11, 2008, 1 page.

Wikipedia, "Linear feedback shift register", Web article, last modified Nov. 11, 2008, 6 pages.

Wikipedia, "Golomb Ruler", Web article, last modified Nov. 4, 2008, 3 pages.

Wikipedia, "Costas Array", Web article, last modified Oct. 7, 2008, 4 pages.

Wikipedia, "Walsh Code", Web article, last modified Sep. 17, 2008, 2 pages.

Wikipedia, "Gold Code", Web article, last modified Jul. 27, 2008, 1 page.

Wikipedia, "Bitter Electromagnet", Web article, last modified Aug. 2011,1 page.

Pill-soo Kim, "A future cost trends of magnetizer systems in Korea", Industrial Electronics, Control, and Instrumentation, 1996, vol. 2, Aug. 5, 1996, pp. 991-996.

United States Office Action, dated Aug. 26, 2011, issued in counterpart U.S. Appl. No. 12/206,270.

United States Office Action, dated Mar. 12, 2012, issued in counterpart U.S. Appl. No. 12/206,270.

United States Office Action, dated Feb. 22, 2011, issued in counterpart U.S. Appl. No. 12/476,952.

United States Office Action, dated Oct. 12, 2011, issued in counterpart U.S. Appl. No. 12/476,952.

United States Office Action, dated Mar. 9, 2012, issued in counterpart U.S. Appl. No. 13/371,280.

International Search Report and Written Opinion, dated May 14, 2009, issued in related International Application No. PCT/US2009/038925.

International Search Report and Written Opinion, dated Jul. 13, 2010, issued in related International Application No. PCT/US2010/021612.

International Search Report and Written Opinion dated Jun. 1, 2009, issued in related International Application No. PCT/US2009/002027.

International Search Report and Written Opinion, dated Aug. 18, 2010, issued in related International Application No. PCT/US2010/036443.

International Search Report and Written Opinion, dated Apr. 8, 2011 issued in related International Application No. PCT/US2010/049410.

United States Office Action issued in U.S. Appl. No. 13/470,994 dated Aug. 8, 2013.

United States Office Action issued in U.S. Appl. No. 13/430,219 dated Aug. 13, 2013.

Atallah, K., Calverley, S.D., D. Howe, 2004, "Design, analysis and realisation of a high-performance magnetic gear", IEE Proc.-Electr. Power Appl., vol. 151, No. 2, Mar. 2004.

Atallah, K., Howe, D. 2001, "A Novel High-Performance Magnetic Gear", IEEE Transactions on Magnetics, vol. 37, No. 4, Jul. 2001, p. 2844-46.

(56) References Cited

OTHER PUBLICATIONS

Boston Gear 221S-4, One-stage Helical Gearbox, http://www.bostongear.com/pdf/product_sections/200_series_helical.pdf, referenced Jun. 2010.
Charpentier et al., 2001, "Mechanical Behavior of Axially Magnetized Permanent-Magnet Gears", IEEE Transactions on Magnetics, vol. 37, No. 3, May 2001, p. 1110-17.
Chau et al., 2008, "Transient Analysis of Coaxial Magnetic Gears Using Finite Element Comodeling", Journal of Applied Physics, vol. 103.
Choi et al., 2010, "Optimization of Magnetization Directions in a 3-D Magnetic Structure", IEEE Transactions on Magnetics, vol. 46, No. 6, Jun. 2010, p. 1603-06.
Correlated Magnetics Research, 2009, Online Video, "Innovative Magnetics Research in Huntsville", http://www.youtube.com/watch?v=m4m81JjZCJo.
Correlated Magnetics Research, 2009, Online Video, "Non-Contact Attachment Utilizing Permanent Magnets", http://www.youtube.com/watch?v=3xUm25CNNgQ.
Correlated Magnetics Research, 2010, Company Website, http://www.correlatedmagnetics.com.
Furlani 1996, "Analysis and optimization of synchronous magnetic couplings", J. Appl. Phys., vol. 79, No. 8, p. 4692.
Furlani, E.P., 2000, "Analytical analysis of magnetically coupled multipole cylinders", J. Phys. D: Appl. Phys., vol. 33, No. 1, p. 28-33.
General Electric DP 2.7 Wind Turbine Gearbox, http://www.gedrivetrain.com/insideDP27.cfm, referenced Jun. 2010.
Ha et al., 2002, "Design and Characteristic Analysis of Non-Contact Magnet Gear for Conveyor by Using Permanent Magnet", Conf. Record of the 2002 IEEE Industry Applications Conference, p. 1922-27.
Huang et al., 2008, "Development of a Magnetic Planetary Gearbox", IEEE Transactions on Magnetics, vol. 44, No. 3, p. 403-12.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-547.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Notice of Allowance issued in U.S. Appl. No. 13/471,189 dated Apr. 3, 2013.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action issued in U.S. Appl. No. 13/530,893 dated Oct. 29, 2013.
United States Office Action issued in U.S. Appl. No. 13/470,994 dated Nov. 8, 2013.

* cited by examiner

FIG. 1A Barker 7 code = +1 +1 +1 −1 −1 +1 −1
010
012
FIG. 1B 1R = -1
FIG. 1C 1A +1R = 0
FIG. 1D 1A + 2R = -1
FIG. 1E 2A + 2R = 0
FIG. 1F 2A + 3R = -1
FIG. 1G 3A + 3R = 0
FIG. 1H 7A = 7
FIG. 1I 7A = 7
FIG. 1J 3A + 3R = 0
FIG. 1K 2A + 3R = -1
FIG. 1L 2A + 2R = 0
FIG. 1M 1A + 2R = -1
FIG. 1N 1A +1R = 0
FIG. 1O 1R = -1
012a
012b 100
102
104
106
108

100
106
102
108
104

100
110

202

204
208
210
206

212

500
502
504

500
402
502
504
208
208
402

508
404
208
506
404
404
404

600
506
404
208
406
404
500c
500b
500a
500d
404
404

600

600

700
704
702
104

700
704
702
104

212

202

706
212
212
202
700b
700a 706c
706b
706d
706a 706f
7063
706d
706c
706b
706a
Could all be the same or could have composite field in accordance with a code 706c
706b
706a

SYSTEM AND METHOD FOR PRODUCING STACKED FIELD EMISSION STRUCTURES

CROSS-REFERENCE TO RELATED APPLICATIONS

This patent application claims the priority benefit of U.S. Provisional Application No. 61/404,147 filed Sep. 27, 2010, which is incorporated herein by reference in its entirety.

FIELD OF THE INVENTION

The present invention relates generally to a system and method for producing stacked field emission structures. More particularly, the present invention relates to a system and method for producing stacked field emission structures that can be manipulated to vary field emissions.

BACKGROUND OF THE INVENTION

Field emission structures have been utilized in a variety of ways to make use of their field characteristics. Such field characteristics have been used in tools for moving or aligning objects. For example, magnets have been used for moving metal sheets from a stack of metal sheets stacked on top of each other. Known magnets however do not provide granularity for controlling the number of sheets that could be picked up from the stack. A conventional magnet with a specific field emission characteristic may pick up all of the sheets on the stack when the application requires picking only one sheet on top of the stack. Accordingly, there exists a need for an emission field structure having an adjustable emission property that could accommodate various applications for movement or alignment of objects.

SUMMARY OF THE INVENTION

Briefly, according to the invention, a stacked field emission system having an outer surface includes at least three field emission structure layers having a stacked relationship that defines a field characteristic of the outer surface. A constraining mechanism maintains the at least three field emission structure layers in the stacked relationship. The mechanisms holds the at least three field emission structure layers such that a plurality of interface surfaces of the at least three field emission structure layers correspond to a plurality of interface boundaries between adjacent field emission structure layers. Each of the at least three field emission structure layers includes a plurality of field emission sources having positions, polarities, and field strengths in accordance with a spatial force function that corresponds to a relative alignment of the at least three field emission structures layers in the stacked relationship. A movement of at least one of the at least three field emission structures varies the field characteristics of the outer surface.

According to some of the more detailed featured of the invention, the field emission sources of the at least three field emission structure layers have polarities in accordance with at least one code. The polarities can be in accordance with the same code or different codes. The at least three field emission structure layers can be aligned to achieve correlation of all of the field emission sources.

According to other more detailed features of the invention, the stacked relationship includes at least one of a vertically stacked relationship, a horizontally stacked relationship, or a concentrically stacked relationship. As such, the movement of the layers relative to each other could be rotational movement or translational movement.

According to yet more detailed features of the invention, the plurality of emission sources include emission sources having field emission vectors substantially perpendicular to a surface of a layer. Alternatively, the plurality of emission sources include emission sources having field emission vectors not perpendicular to a surface of a layer. As such, the plurality of emission sources can form a Halbach array.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
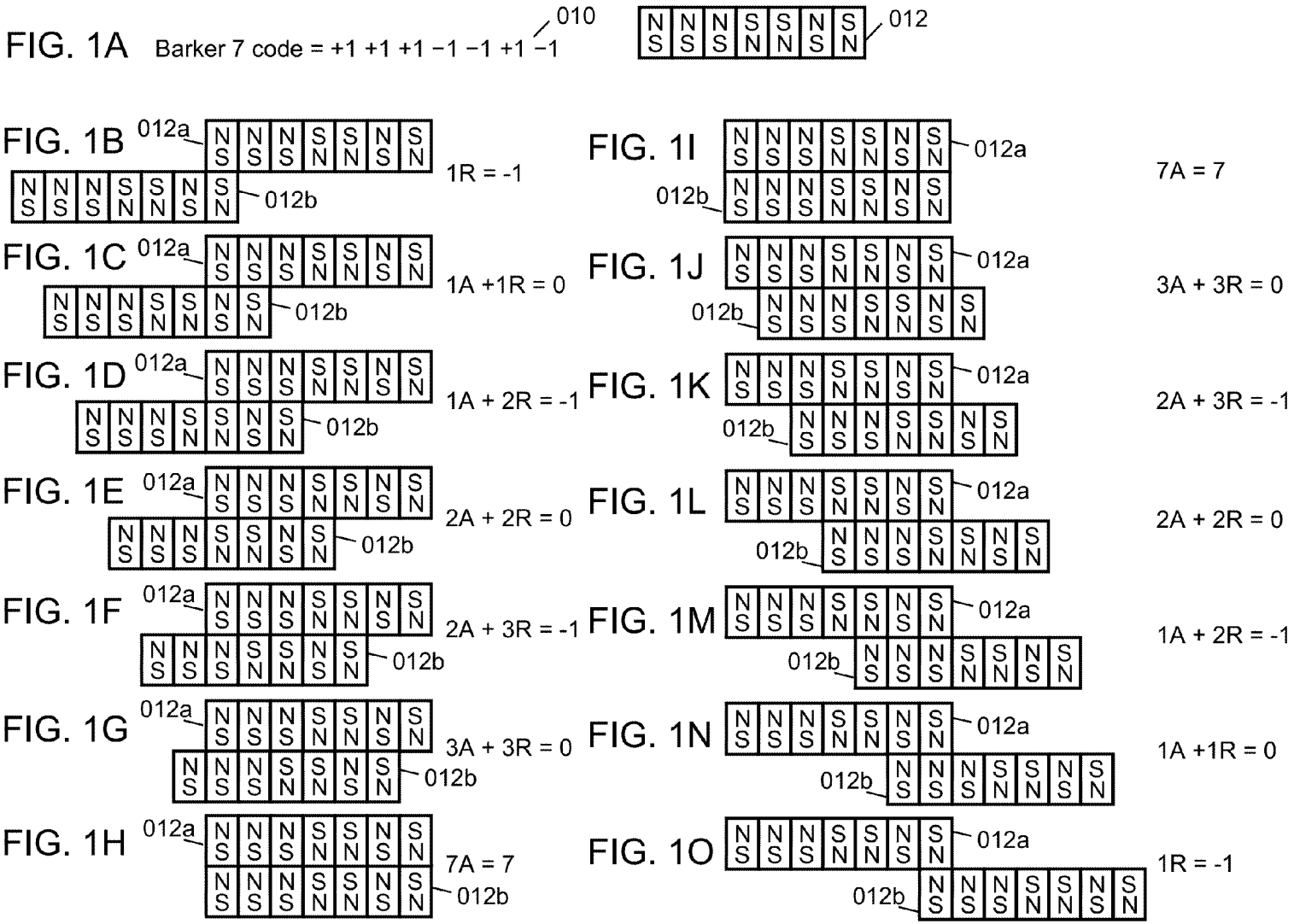
FIG. 1A depicts a code defining polarities and positions of field emission sources making up a field emission structure layer.
FIGS. 1B-1O depict exemplary alignments of two interfacing field emission structure layers.
FIG. 1P provides an alternative method of depicting exemplary alignments of the two field emission structure layers of FIGS. 1B-1O.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides a system and method for producing stacked field emission structures. It involves field emission techniques related to those described in U.S. Pat. No. 7,800,471, issued Sep. 21, 2010, U.S. patent application Ser. No. 12/358,423, filed Jan. 23, 2009, U.S. patent application Ser. No. 12/476,952, filed Jun. 2, 2009, and U.S. patent application Ser. No. 12/885,450, filed Sep. 18, 2010, which are all incorporated herein by reference in their entirety. Such systems and methods described in U.S. Pat. No. 7,681,256, issued Mar. 23, 2010 and U.S. patent application Ser. No. 12/322,561, filed Feb. 4, 2009, U.S. patent application Ser. Nos. 12/478,889, 12/478,939, 12/478,911, 12/478,950, 12/478,969, 12/479,013, 12/479,073, 12/479,106, filed Jun. 5, 2009, U.S. patent application Ser. Nos. 12/479,818, 12/479,820, 12/479,832, and 12/479,832, file Jun. 7, 2009, U.S. patent application Ser. No. 12/494,064, filed Jun. 29, 2009, U.S. patent application Ser. No. 12/495,462, filed Jun. 30, 2009, U.S. patent application Ser. No. 12/496,463, filed Jul. 1, 2009, U.S. patent application Ser. No. 12/499,039, filed Jul. 7, 2009, U.S. patent application Ser. No. 12/501,425, filed Jul. 11, 2009, U.S. patent application Ser. No. 12/507,015, filed Jul. 21, 2009, and U.S. patent application Ser. No. 12/783,409, filed Jun. 19, 2010 are all incorporated by reference herein in their entirety.

In accordance with one embodiment of the present invention, a stacked field emission system (or stack) involves a plurality of layers with each layer comprising a field emission structure having field emission sources having positions, polarities, and field strengths in accordance with a spatial force function that corresponds to a relative alignment of the plurality of field emission structures within a field domain. The stack has a first outer surface corresponding to a bottom surface of the field emission structure at the bottom of the stack and a second outer surface corresponding to a top surface of the field emission structure at the top of the stack, and a plurality of interface surfaces each corresponding to one or more interface boundaries between two interfacing surfaces of two field emission structures making up the stack. When all of the field emission structures of the stack are aligned, a peak spatial force is produced by the stack. By misaligning at least one of the field emission structures in the stack, the field emissions of at least one of the first outer surface or the second outer surface are varied.

Generally, codes can be defined that will cause specific field emission characteristics to be achieved via specific manipulations of layers of the stack. For example, the same code can be applied to each field emission structure in a stack comprising three field emission structures.

FIG. 1A depicts a code defining polarities and positions of field emission sources making up a field emission structure layer. Referring to FIG. 1A, a Barker length 7 code 010 is used to determine the polarities and the positions of seven field emission sources making up a field emission structure layer 012. Each region of the field emission structure layer has the same or substantially the same magnetic field strength (or amplitude), which for the sake of this example is provided a unit of 1 (where A=Attract, R=Repel, A=−R, A=1, R=−1).

Two field emission structure layers may interact with one another based on the polarities, positions, and field strengths of the field emission sources of the field emission structure layers. The boundary where the field emission structure layers interact is referred to herein as an interface boundary. The surfaces of the field emission structure layers interacting in the interface boundary are referred to herein as interface surfaces. Interaction of the field emission structure layers results in attractive and repulsive forces between the field emission structure layers.

FIGS. 1B through 1O depict different alignments of two interfacing field emission structure layers like that of FIG. 1A. Referring to FIGS. 1B through 1O, a first field emission structure layer 012*a* is held stationary. A second field emission structure layer 012*b* that is identical to the first field emission structure layer 012*a* is shown sliding from left to right in thirteen different alignments relative to the first field emission structure layer 012*a* in FIGS. 1B through 1O. (Note that although the first field emission structure layer 012*a* is identical to the second field emission structure layer in terms of magnet field directions, the interfacing poles are of opposite or complementary polarity).

Movement of a field emission structure layer relative to another field emission structure layer changes the total magnetic force between the first and second field emission structure layers 012*a* 012*b*. The total magnetic force is determined as the sum from left to right along the structure layer of the individual forces at each field emission source position of field emission sources interacting with its directly opposite corresponding field emission source in the opposite field emission structure layer. In a field emission source position where only one field emission source exists, the corresponding field emission source is 0, and the force is 0. Where two field emission sources exist, the force is R for equal poles or A for opposite poles. Thus, for FIG. 1B, the first six positions to the left have no interaction. The one position in the center shows two "S" poles in contact for a repelling force of 1. The next six positions to the right have no interaction, for a total force of 1R=−1, a repelling force of magnitude 1. The spatial correlation of the field emission sources for the various alignments is similar to radio frequency (RF) signal correlation in time, since the force is the sum of the products of the field emission source strengths and polarities and the opposing field emission source strengths and polarities over the lateral width of the structure. Thus, $$f = \sum_{n=1,N} p_n q_n$$

where, $f$ is the total magnetic force between the two field emission structure layers, n is the position along the structure up to maximum position N, and $p_n$ are the strengths and polarities of the lower field emission source at each position n.

$q_n$ are the strengths and polarities of the upper field emission source at each position n.

An alternative equation separates strength and polarity variables, as follows:

$$f = \sum_{n=1,N} l_n p_n u_n q_n$$

where, $f$ is the total magnetic force between the two field emission structure layers, n is the position along the field emission structure layer up to maximum position N, $l_n$ are the strengths of the lower field emission sources at each position n, $p_n$ are the polarities (1 or −1) of the lower field emission sources at each position n, $u_n$ are the strengths of the upper field emission sources at each position n, and $q_n$ are the polarities (1 or −1) of the upper field emission sources at each position n.

The above force calculations can be performed for each shift of the two field emission structure layers to plot a force vs. position function for the two field emission structure layers. A force vs. position function may alternatively be called a spatial force function. In other words, for each relative alignment, the number of field emission source pairs that repel plus the number of field emission source pairs that attract is calculated, where each alignment has a spatial force in accordance with a spatial force function based upon the correlation function and magnetic field strengths of the field emission sources.

With the specific Barker code used, it can be observed from the figures that the spatial force varies from −1 to 7, where the peak occurs when the two field emission structure layers are aligned such that their respective codes are aligned as shown in FIG. 1H and FIG. 1I. (FIG. 1H and FIG. 1I show the same alignment, which is repeated for continuity between the two columns of figures). The off peak spatial force, referred to as a side lobe force, varies from 0 to −1. As such, the spatial force function causes the two field emission structure layers to generally repel each other unless they are aligned such that each of their field emission sources is correlated with a complementary field emission source (i.e., a field emission source's South pole aligns with another field emission source's North pole, or vice versa). In other words, the two field emission structure layers substantially correlate when they are aligned such that they substantially mirror each other.

Figure 1P:
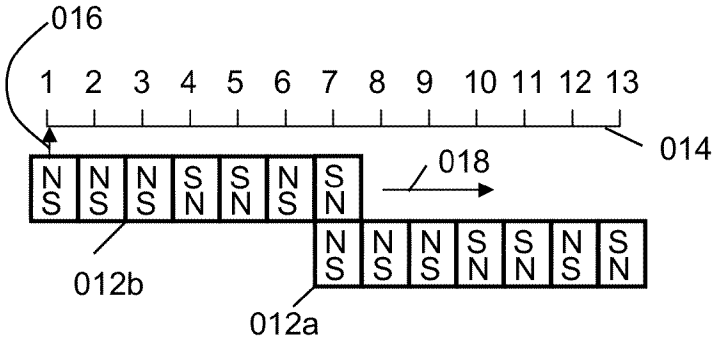

FIG. 1P depicts the sliding action shown in FIGS. 1B through 1O in a single diagram. In FIG. 1P, a first field emission structure layer 012*a* is stationary while a second field emission structure layer 012*b* is moved across the top of the first field emission structure layer 012*a* in one direction 003 according to a scale 014. The second field emission structure layer 012*b* is shown at position 1 according to an indicating pointer 016, which moves with the left field emission source of the second field emission structure layer 012*b*. As the second field emission structure layer 012*b* is moved from left to right, the total attraction and repelling forces are determined and plotted in the graph of FIG. 2.

Figure 2:
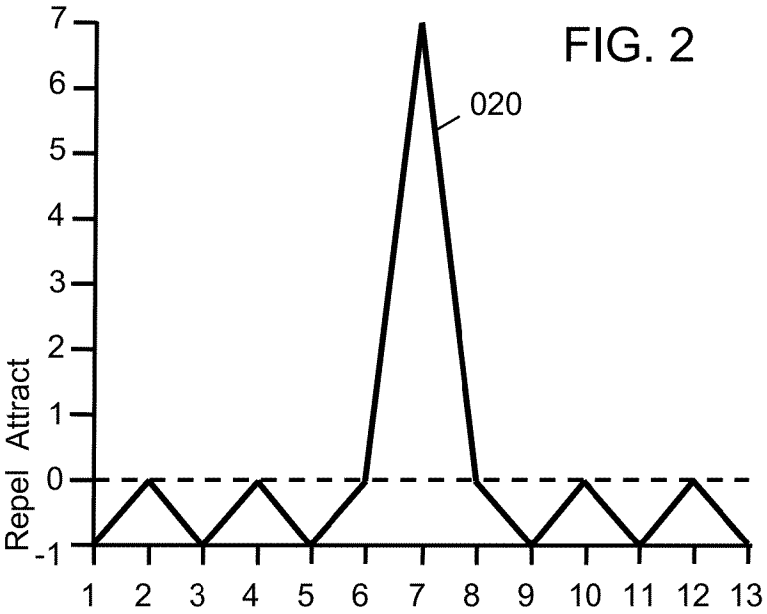
FIG. 2 depicts the binary autocorrelation function of a Barker length 7 code.

FIG. 2 depicts the binary autocorrelation function 020 of the Barker length 7 code, where the values at each alignment position 1 through 13 correspond to the spatial force values calculated for the thirteen alignment positions shown in FIGS. 1B through 1O (and in FIG. 1P). As such, since the field emission sources making up the field emission structure layers 012*a*, 012*b* have the same magnetic field strengths, FIG. 2 also depicts the spatial force function of the two field emission structure layer of FIGS. 1B-1O and 1P.

As the true autocorrelation function for correlated magnet field structures is repulsive, and most of the uses envisioned will have attractive correlation peaks, the usage of the term 'autocorrelation' herein will refer to complementary correlation unless otherwise stated. That is, the interacting faces of two such correlated field emission structure layers will be complementary to (i.e., mirror images of) each other. This complementary autocorrelation relationship can be seen in FIG. 1B where the bottom face of the first field emission structure layer 012*b* having the pattern 'S S S N N S N' is shown interacting with the top face of the second field emission structure layer 012*a* having the pattern 'N N N S S N S', which is the mirror image (pattern) of the bottom face of the first field emission structure layer 012*b*.

The attraction functions of FIG. 2 and others in this disclosure are idealized, but illustrate the main principle and primary performance. The curves show the performance assuming equal magnet size, shape, and strength and equal distance between corresponding magnets. For simplicity, the plots only show discrete integer positions and interpolate linearly. Actual force values may vary from the graph due to various factors such as diagonal coupling of adjacent field emission sources, field emission source shape, spacing between field emission sources, properties of magnetic materials, etc. The curves also assume equal attract and repel forces for equal distances. Such forces may vary considerably and may not be equal depending on field emission source material and field strengths. High coercive force materials typically perform well in this regard.

Codes may also be defined for a field emission structure layer having non-linear field emission sources.

Figure 3A:
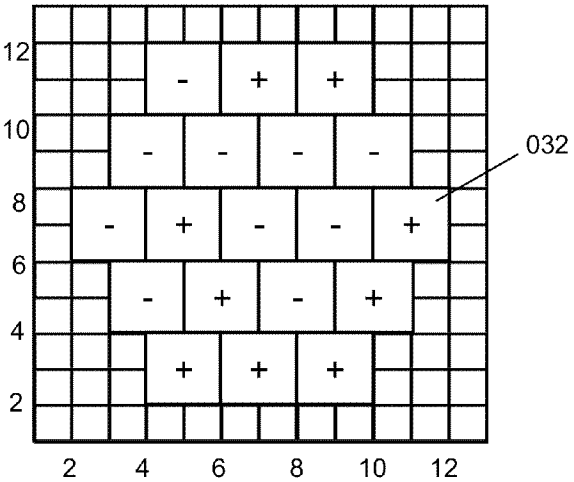
FIG. 3A depicts an exemplary code intended to produce a field emission structure layer having a first stronger lock when aligned with its mirror image field emission structure layer and a second weaker lock when rotated 90° relative to its mirror image field emission structure layer.

FIG. 3A depicts an exemplary code 0302 intended to produce a field emission structure layer having a first stronger lock when aligned with its mirror image field emission structure layer and a second weaker lock when rotated 90° relative to its mirror image field emission structure layer. FIG. 3A shows field emission structure layer 0302 is against a coordinate grid 0304. The field emission structure layer 0302 of FIG. 3A comprises field emission sources at positions: −1(3,7), −1(4,5), −1(4,7), +1(5,3), +1(5,7), −1(5,11), +1(6,5), −1(6,9), +1(7,3), −1(7,7), +1(7,11), −1(8,5), −1(8,9), +1(9,3), −1(9,7), +1(9,11), +1(10,5), −1(10,9)+1(11,7). Additional field emission structures may be derived by reversing the direction of the x coordinate or by reversing the direction of the y coordinate or by transposing the x and y coordinates.

Figure 3B:
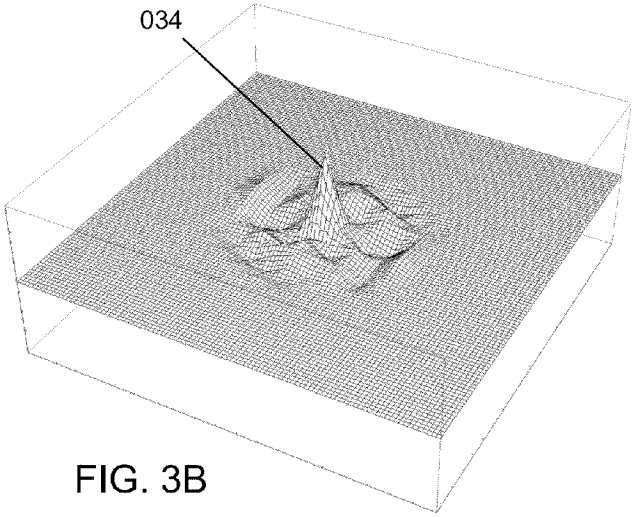
FIG. 3B depicts spatial force function of a field emission structure layer interacting with its mirror image field emission structure layer.

FIG. 3B depicts spatial force function 0306 of a field emission structure layer 0302 interacting with its mirror image field emission structure layer. The peak occurs when substantially aligned.

Figure 3C:
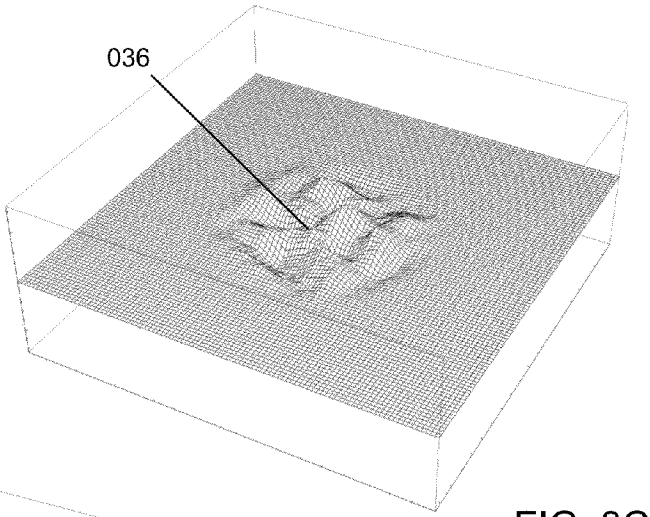
FIG. 3C depicts the spatial force function of a field emission structure layer interacting with its mirror field emission structure layer after being rotated 90°.

FIG. 3C depicts the spatial force function 0308 of field emission structure layer 0302 interacting with its mirror field emission structure layer after being rotated 90°. The peak occurs when substantially aligned but one structure rotated 90°.

FIGS. 4A-4I depict the exemplary field emission structure layer 0302*a* and its mirror image field emission structure layer 0302*b* and the resulting spatial forces produced in accordance with their various alignments as they are twisted relative to each other.

Figure 4A:
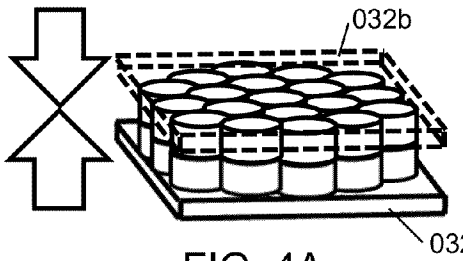
FIGS. 4A-4I depict the exemplary field emission structure layer of FIG. 3A and its mirror image field emission structure layer in accordance with their various alignments as they are twisted relative to each other.
Figure 4B:
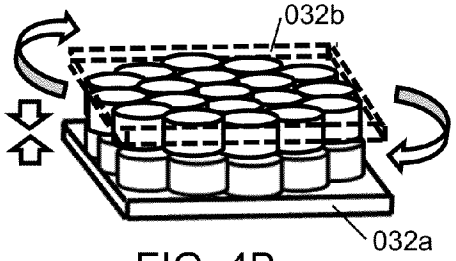
Figure 4C:
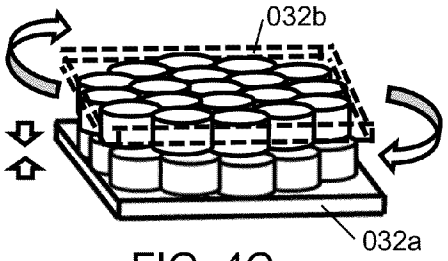
Figure 4D:
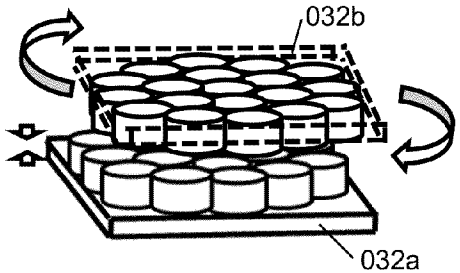
Figure 4E:
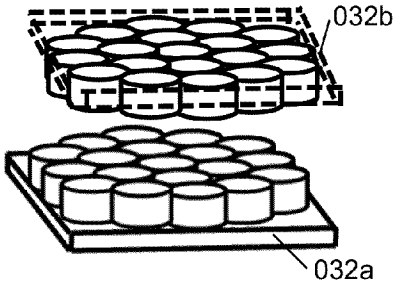
Figure 4F:
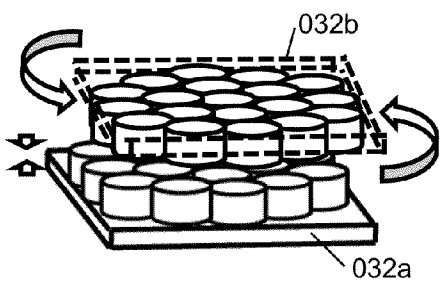
Figure 4G:
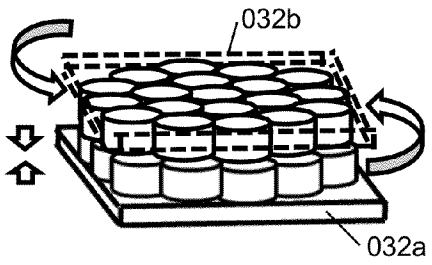
Figure 4H:
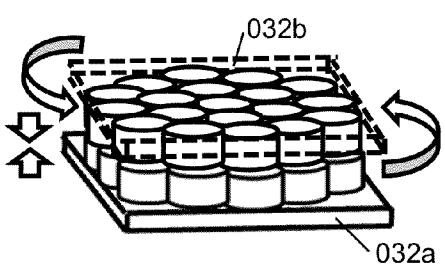
Figure 4I:
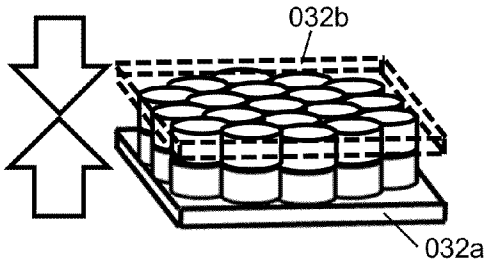

In FIG. 4A, the field emission structure layer 0302*a* and the mirror image field emission structure layer 0302*b* are aligned producing a peak spatial force. In FIG. 4B, the mirror image field emission structure layer 0302*b* is rotated clockwise slightly relative to the field emission structure layer 0302*a* and the attractive force reduces significantly. In FIG. 4C, the mirror image field emission structure layer 0302*b* is further rotated and the attractive force continues to decrease. In FIG. 4D, the mirror image field emission structure layer 0302*b* is still further rotated until the attractive force becomes very small, such that the two field emission structure layers are easily separated as shown in FIG. 4E. Given the two field emission structure layers held somewhat apart as in FIG. 4E, the structures layers can be moved closer and rotated towards alignment producing a small spatial force as in FIG. 4F. The spatial force increases as the two structures become more and more aligned in FIGS. 4G and 4H and a peak spatial force is achieved when aligned as in FIG. 4I.

It should be noted that the direction of rotation was arbitrarily chosen and may be varied depending on the code employed. Additionally, the mirror image field emission structure layer 0302*b* is the mirror of field emission structure layer 0302*a* resulting in an attractive peak spatial force. The mirror image field emission structure layer 0302*b* could alternatively be coded such that when aligned with the field emission structure layer 0302*a* the peak spatial force would be a repelling force in which case the directions of the arrows used to indicate amplitude of the spatial force corresponding to the different alignments would be reversed such that the arrows faced away from each other.

The present invention relates to a stacked field emission system having an outer surface. The outer surface of the system has a field emission characteristic that is defined by the positioning of the at least three field emission structure layers in a stacked relationship. As such the stacked relationship of the layers defines the defines the field characteristic of the outer surface. The stacked relationship of the field emission structure layers is formed by holding the at least three field emission structure layers such that a plurality of interface surfaces of the at least three field emission structure layers correspond to a plurality of interface boundaries between adjacent field emission structure layers. A constraining mechanism maintains the three field emission structure layers in the stacked relationship.

In a stacked relationship between only three field emission structure layers, there are a middle layer and two outer layers, each positioned next to the middle layer. As further described below, the three layers could be stacked on top of each other along a vertical axis, side by side along a horizontal axis or concentrically along a radial axis. Assuming stacking along the vertical axis where the layers are stacked on top of each other, for example, the middle layer has a plurality of two opposing interface surfaces: one adjacent to a top layer and another adjacent to a bottom layer. In this way, each one on the two opposing surfaces defines an interface boundary between adjacent field emission structure layers. Under the vertically stacked relationship, for example, an interface boundary is formed between the middle layer and the adjacent top layer and another interface boundary is formed between the middle layer and the adjacent bottom layer. The constraining mechanism maintains the three field emission structure layers in the stacked relationship such that the plurality of interface surfaces of the three field emission structure layers correspond to a plurality of interface boundaries between adjacent field emission structure layers.

According to the present invention, a movement of one of the three field emission structures varies the field characteristics of the outer surface. This is achieved by having each one of the three field emission structure layers comprising a plurality of field emission sources having positions, polarities, and field strengths in accordance with a spatial force function that corresponds to a relative alignment of the three field emission structures layers in the stacked relationship. In a stacked relationship with two outer layers positioned next to the middle layer, when all three field emission structure layers are aligned, a first and a second peak field strengths will be produced at each of the two outer surfaces of the stacked field emission system because all the vectors of the various field emission sources are aligned. By misaligning the top structure, via a movement, from the middle and bottom structure while retaining the alignment of the middle and bottom structure, the top surface and the bottom surface will both exhibit a lower field strengths than the first and second peak field strengths produced when all the structures layers are aligned. This is the result of certain vector cancellation, where there are numerous different misalignment positions of the top structure layer relative to the middle and bottom structure layers. In this way, the movement of the top field emission structure layer varies the field characteristics of the outer surface.

Similarly, by misaligning the middle structure layer from the top and bottom structure layers while retaining the alignment of the top and bottom structure layers, the top surface and the bottom surface will both exhibit lower field strengths than the first and second peak field strengths produced when all the structure layers are aligned. In this way, the movement of the middle field emission structure layer varies the field characteristics of the outer surface. Similarly, the top two structure layers can be misaligned from the bottom structure layer while maintaining alignment with each other and field strengths will be produced at the two outer surfaces, where there are numerous different misalignment positions of the bottom structure relative to the middle and top structure layer. In this way, the movement of the top and middle field emission structure layers varies the field characteristics of the outer surface.

Furthermore, all three structures can be manipulated so that they are all misaligned to produce field emissions at the outer surfaces, where there are numerous different misalignment positions of the various structure layers. Generally, all sorts of different combinations are possible, which the number of possibilities increasing with the number of layers. As such, manipulation of the a stacked field emission system enables all the vectors of the field emissions to be aligned or to be misaligned in various ways such that cancel at different interface surfaces within the stack, which can be described as vertical vector cancellation. Accordingly, any movement of any one of the three field emission structures varies the field characteristics of the outer surface.

Under one arrangement, a plurality of field emission structure layers are each circular with a central hole in each enabling them to each turn about a central axle. The axle is attached to the bottom field emission structure of the stack and to a top plate that is on top of the stack. A handle is attached to the top plate. The distance between the top plate and the bottom field emission structure is sufficient to enable the rotation of the field emission structures other than the bottom field emission structure layer thereby enabling a person or an automated device (e.g., a robot) to manipulate the stacked field emission system to achieve different field strengths at the bottom of the stack. One skilled in the art will recognize that any one of various methods of achieving differential rotation can be used to cause one or more of the field emission structure layers to turn while maintaining alignment of other field emission structure layers.

Figures 5A, 5B, 5C, 6A, 6B, 6C:
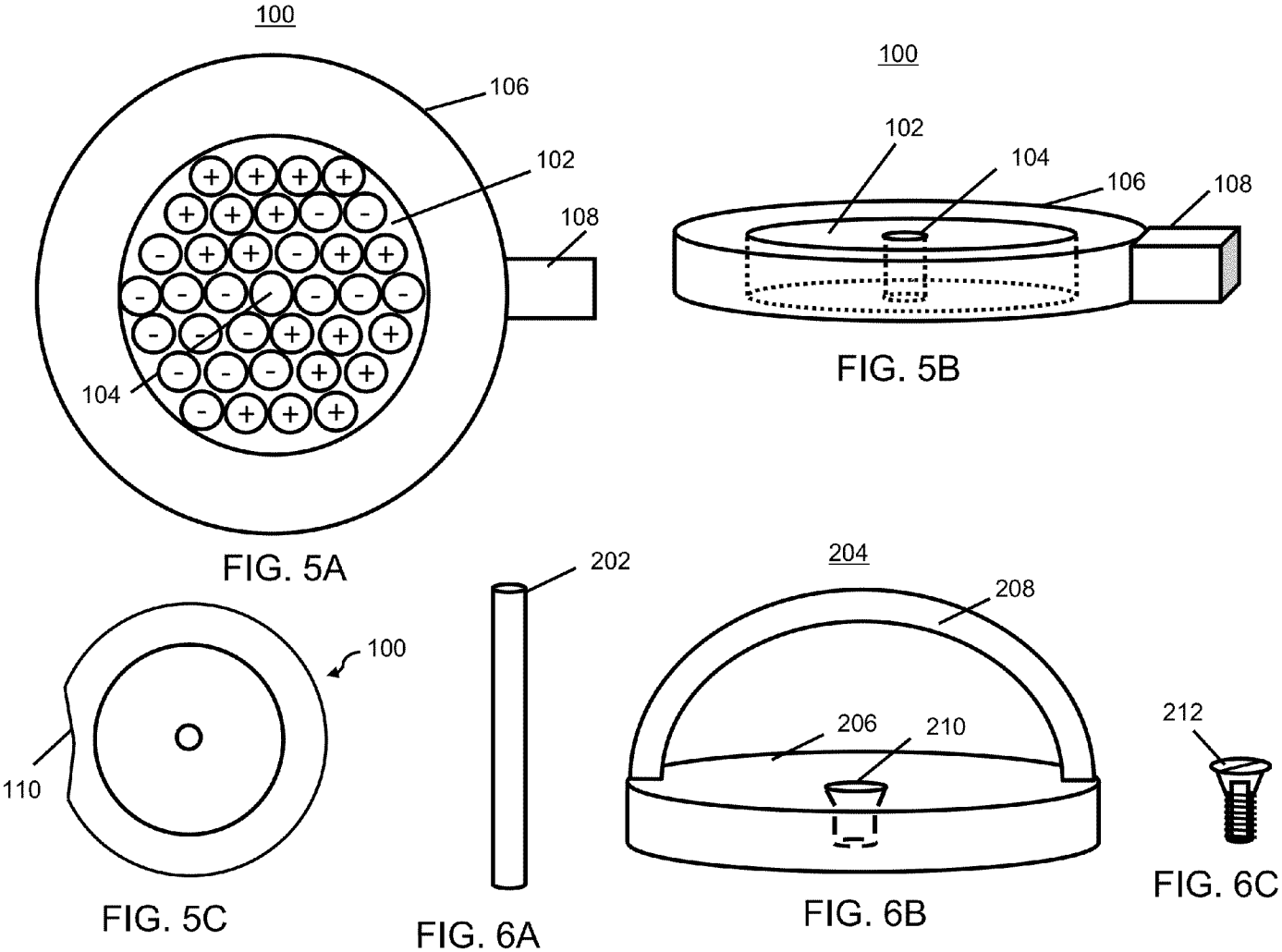
FIG. 5A depicts a top view of an exemplary layer including a round field emission structure.
FIG. 5B depicts an oblique view of the exemplary round layer of FIG. 5A.
FIG. 5C depicts another alternative exemplary layer like that of FIG. 5A that has a notch instead of a movement tab.
FIG. 6A depicts an exemplary axle with threads inside both ends.
FIG. 6B depicts an exemplary fixture for use with a stacked field emission.
FIG. 6C depicts an exemplary screw.

In one embodiment, the plurality of emission sources are positioned on each one of the layers according to a respective polarity pattern that corresponds to a code associated with each layer. In this way, a movement of one layer relative to another layer from a first position to a second position changes emission field interaction of the field emission structure layers according to a change in a correlation function between codes associated with the layers. Such change in the correlation relationship varies the field characteristics of the outer surface. FIG. 5A depicts a top view of an exemplary layer 100 including a round field emission structure 102 having a plurality of field emission sources having positions, polarities, and field emission strengths in accordance with a code and a hole 104 to allow rotational movement, an optional outer substrate 106, and an optional movement tab 108. The code used to define the field emission sources is also exemplary. For clarities sake, such field emission sources are present but not depicted in any of the remaining figures but one skilled in the art will recognize that all sorts of different arrangements of such field emission sources are possible in accordance with the present invention. Furthermore, the optional movement tab is an exemplary movement assistance device. One skilled in the art will recognize that all sorts of different movement assistance devices could be employed in accordance with the present invention.

FIG. 5B depicts an oblique view of the exemplary layer 100 of FIG. 5A. FIG. 5C depicts another alternative exemplary layer 100 like that of FIG. 5A that has a notch 110 instead of a movement tab 108. One skilled will recognize that many different types of notches 110 or other non-round variations in the shape of a substrate (e.g., ribs) can be used to provide movement assistance. FIG. 6A depicts an exemplary axle 202 with threads inside both ends that comprises the constraint mechanism that holds at least three field emission structure layers such that a plurality of interface surfaces of the at least three field emission structure layers correspond to a plurality of interface boundaries between adjacent field emission structure layers, as described above. FIG. 6B depicts an exemplary fixture 204 for use with a stacked field emission system including a round top plate 206, and handle 208, where the top plate 206 has a hole 210 for receiving a constraining screw. FIG. 6C depicts an exemplary constraining screw 212 having threads intended to match the inside threads of the axle 202 of FIG. 6A.

Figure 7B:
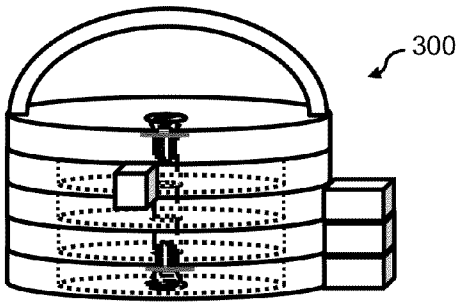
FIGS. 7B-7F depict examples of how the different layers of the stack can be rotated relative to each other to achieve different relative alignments.
Figure 7C:
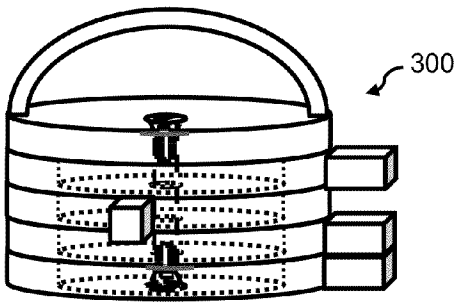
Figure 7D:
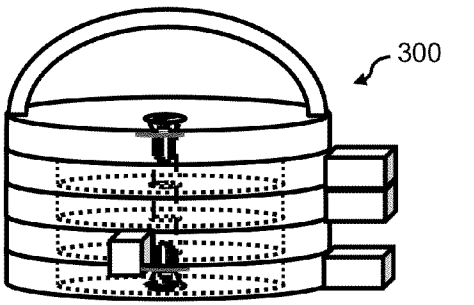
Figure 7A:
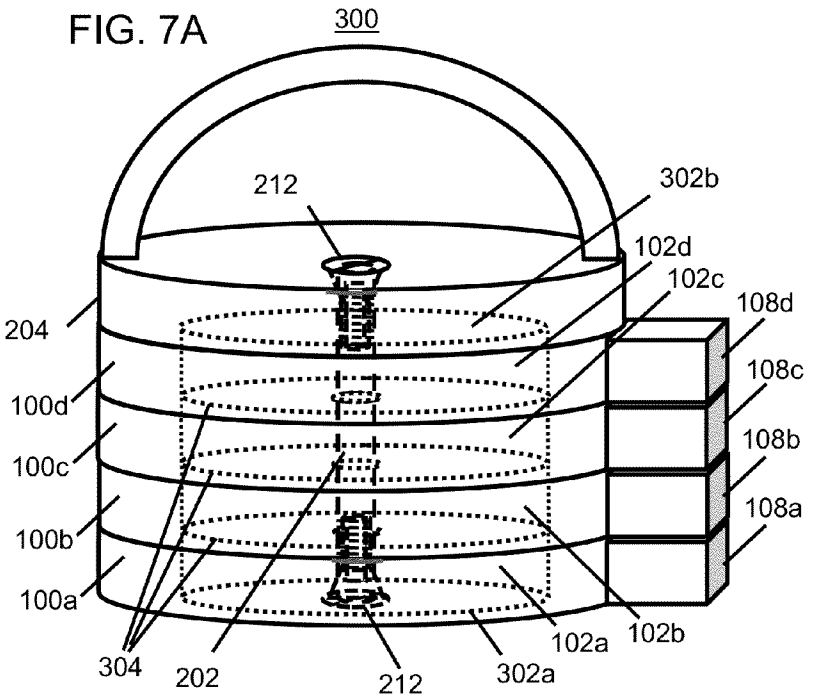
FIG. 7A depicts an exemplary stacked field emission systems.
Figure 7E:
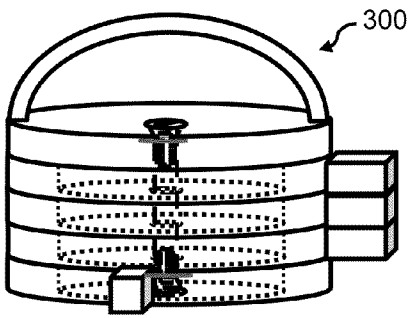
Figure 7F:
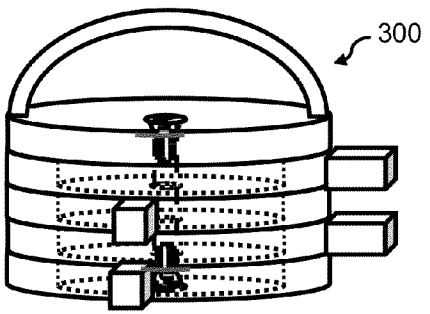

FIG. 7A depicts an exemplary stacked field emission system 200 including a top plate 204, four round field emission structure layers 100*a*-100*d*, axle 202, and two restraining screws 212 212. The system (or stack) could also be as simple as just three layers (with or without outer substrates), the axle, and the two restraining screws. Various types of markings could also be provided to identify field characteristics based on a given alignment(s). Shown are the bottom outside surface 302*a*, top outside surface 302*b*, and three interface boundaries 304 between the four layers 100*a*-100*d*.

FIGS. 7B-7F depict examples of how the different field emission structure layers 100*a*-100*d* of the stack can be rotated relative to each other to achieve different relative alignments. As shown, multiple tabs 108*a*-108*d* may be aligned indicating correlation of field emission structure layers corresponding to those tabs. Tabs 108*a*-108*d* may each be free to travel to any position within a full circle (360°). Alternatively, travel limiting devices (not shown) could be employed to limit movement of a given tab 108*a*-108*d* thereby limiting the range of movement of a layer 100*a*-100*d*.

Figure 8B:
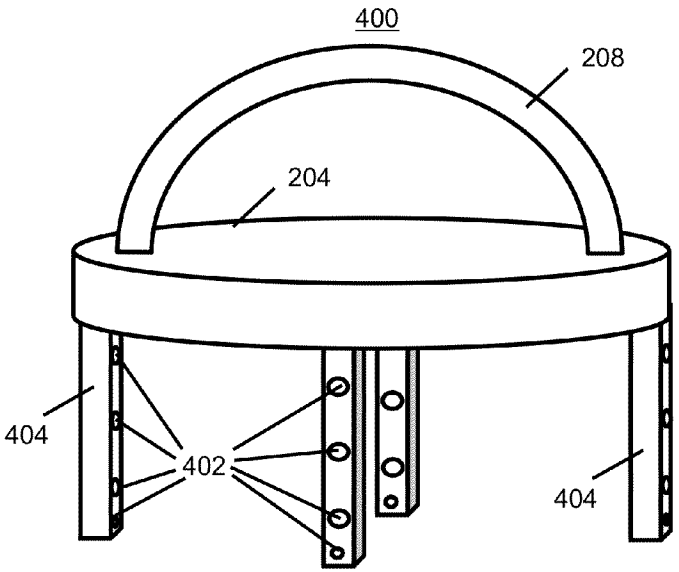
FIG. 8B depicts an alternative exemplary fixture.
Figure 8C:
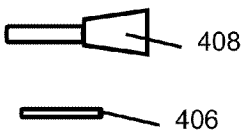
FIG. 8C depicts an exemplary non-removable peg and an exemplary removable peg.
Figure 8A:
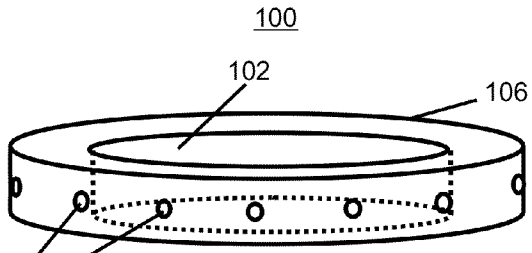
FIG. 8A depicts another alternative exemplary layer including a round field emission structure like that of FIG. 5A and FIG. 5C but having peg holes instead of movement tab or a notch.

FIG. 8A depicts another alternative exemplary layer 100 like that of FIG. 5A and FIG. 5C but having peg holes 402 instead of a movement tab 108 or a notch 110, where peg holes 402 surround the perimeter of the outer substrate 106. The round field emission structure 102 also does not have a hole 104. The number of peg holes 402 can be selected as well as the spacing between peg holes, which need not be uniform and need not surround the perimeter of the outer substrate. Markings could be associated with peg holes 402 to identify field characteristics corresponding to use of the peg holes. It should also be noted that peg holes 402 could be included in the field emission structure if an outer substrate 106 is not employed.

FIG. 8B depicts an alternative exemplary constraining mechanism or fixture 400 that includes a top plate 204 with a handle 208 but without a hole 210, and four constraining braces 404 having peg holes 402. The constraining braces 404 are shown to have flat surfaces but the surfaces inside the fixture could be curved to correspond to the curvature of the layers to be placed with the fixture. More or fewer braces 404 could also be used instead of four braces 404.

Figure 8D:
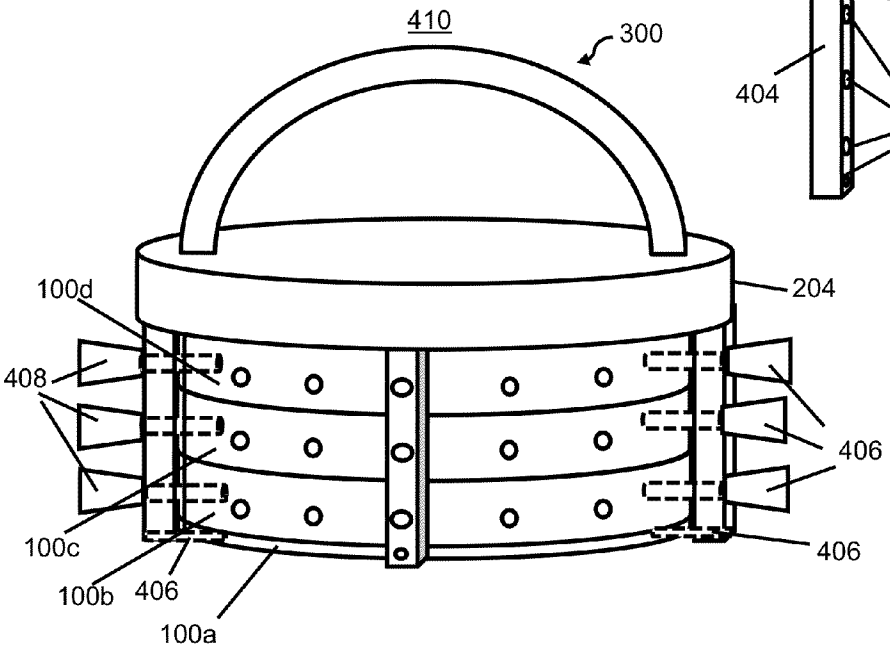
FIG. 8D depicts an exemplary stacked field emission system.

FIG. 8C depicts an exemplary non-removable peg 406 and an exemplary removable peg 408. FIG. 8D depicts an exemplary stacked field emission system 410 including the constraining fixture 400 of FIG. 8B, a relatively thin layer 100*a* at the bottom of the stack, and three additional layers 100*b*-100*d* on top of the first layer 100*a*, where the bottom layer 100*a* has non-removable pegs 406 and cannot rotate and the top three layers 100*b*-100*d* are free to rotate when their corresponding removable pegs 408 are removed. Generally, the thickness of the bottom layer 100*a* determines a minimum field emission of the stack. As such, for a given material and for a given code, magnet source size and shape, and other magnetization variables, a optimal bottom layer thickness can be determined.

Under another arrangement, the stacked field emission system comprises a plurality of field emission structure layers that are each circular but do not have holes and are instead configured to be rotatable within the constraining fixture. Such a stack might resemble the stack of FIG. 8D without peg holes 402 in the upper three layers. Generally, one skilled in the art will recognize that for certain codes, stability between layers can be achieved causing them to remain at a given relative position without requiring peg holes and pegs.

Under another arrangement, the stacked field emission system comprises a plurality of field emission structure layers that are each either rectangular or square and are configured to move slideably within a constraining fixture.

Figures 9A, 9B, 9C, 10A, 10B, 10C:
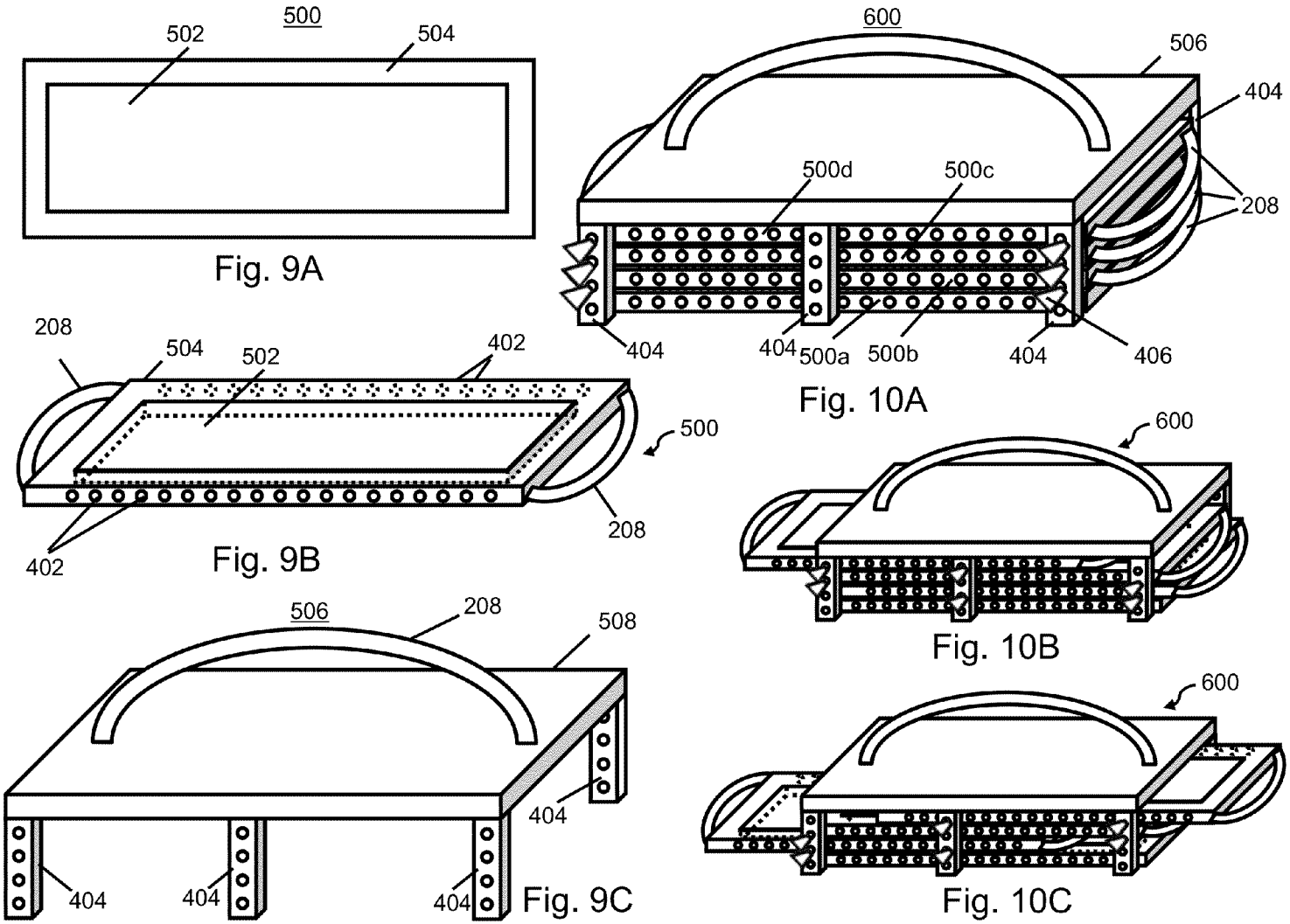
FIG. 9A depicts a top view of an exemplary layer including a rectangular field emission structure.
FIG. 9B depicts an oblique projection of the exemplary layer of FIG. 9A.
FIG. 9C depicts an exemplary fixture.
FIG. 10A depicts an exemplary stacked field emission system.
FIGS. 10B and 10C depict examples of how the different layers can be slidably moved relative to each other to achieve different relative alignments.

FIG. 9A depicts a top view of an exemplary layer 500 including a rectangular field emission structure 502 having an optional outer substrate 504. FIG. 9B depicts an oblique projection of the layer 500 of FIG. 9A having peg holes 402 down two longitudinal sides and handles 208 on two lateral sides. Alternatively, the peg holes 402 could be on the two lateral sides and the handles 208 on then longitudinal sides. As with the round layer 100 of FIG. 8A, the number of peg holes 402 and their spacing can vary where the peg hole spacing need not be uniform. Markings may also indicate expected field characteristics given use of a given alignment peg hole.

FIG. 9C depicts an exemplary fixture 506 that includes a rectangular top plate 508 with handle 208, and six braces 404 having peg holes 402. As depicted, the constraining fixture is configured for longitudinal sliding by the field emission structure layers 500. Alternatively, the fixture could be configured for lateral sliding and or combinations of lateral and longitudinal sliding movement, for example, one or more layers 500 might be configured for longitudinal sliding movement while one or more other layers 500 might be configured for lateral sliding movement. Configurations might also allow a given layer 500 to move both longitudinally and laterally or to move at some angle other than longitudinally or laterally.

FIG. 10A depicts an exemplary stacked field emission system 600 including the constraining fixture 506 of FIG. 5C, a first emission field structure layer 500*a* at the bottom of the stack, and three additional emission field structure layers 500*b*-500*d* on top of the first layer 500*a*, where the bottom layer 500*a* has non-removable pegs and cannot be moved and the top three layers 500*b*-500*d* are free to move or otherwise slide when their corresponding removable pegs 406 are removed. As shown, the four layers 500*a*-500*d* are all aligned, which could correspond to the field emission sources of the layers all being correlated creating an aligned correlation function with peak and off peak field emission sidelobes suitable for a desired application. However, different code shifts and use of different codes are possible such that alignment of the layers doesn't necessarily indicate correlation of all the field emission sources, yet creating a desired spatial force function at the outer surface of the stacked field emission system 600. FIGS. 10B and 10C depict examples of how the different layers can be slid relative to each other to achieve different relative alignments.

Generally, such stacks can have all sorts of sizes and shapes where all sorts of sizes and shapes of field emission structure layers are possible that either rotate about an axle, rotate within a constraining fixture, and/or slide within a constraining fixture. For example, a round stacked field emission system might have field emission structure layers that are rotable and slidable within an oval shaped constraining fixture.

In another embodiment of the invention, a constraining fixture may not be required by a stack produced such that stacking layers remain attached due to their field emission properties. In such arrangement, the constraining mechanism is the field emission properties of the layers themselves. Additionally, a stack can be produced that has some of its layers fixed together, e.g., with an adhesive, such that the field emission characteristics of the fixed layers cannot be changed via movement. Furthermore, a plurality of stacks can be arranged in accordance with a code. For example, three substantially identical stacks each configured to produce substantially the same positive field emission and a fourth stack configured to produce a negative field emission can be aligned in a first array in accordance with a Barker 4 code. A second array of stacks could be configured to be complementary to the first plurality of stacks. Generally, the stacks can be viewed as configurable field emission building blocks enabling precision field characteristics to be achieved via manipulation of layers of individual stacks and such field emission can then be combined as desired.

Figures 11A, 11B, 11C, 11D, 11E, 11F, 11G, 11H:
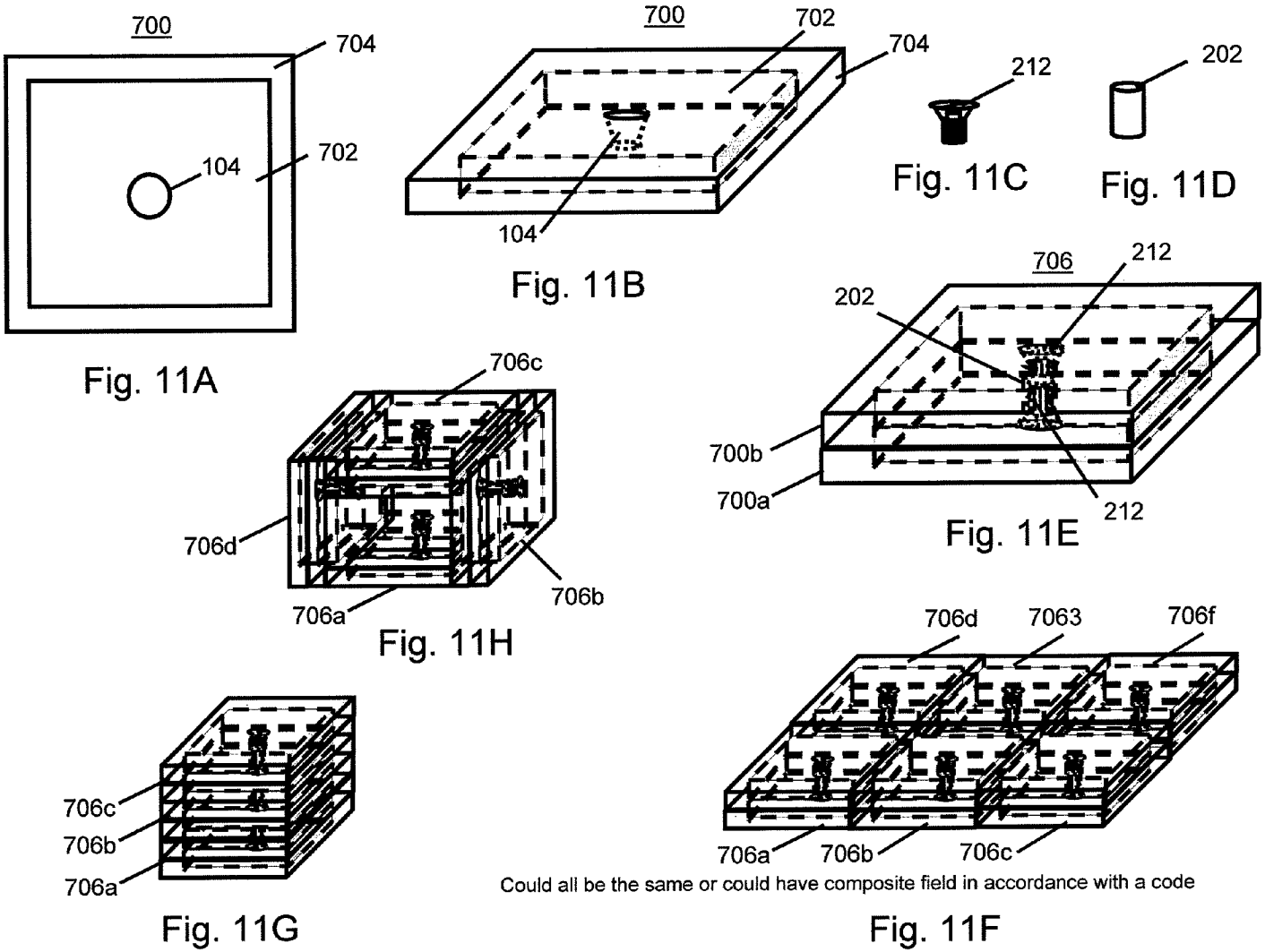
FIG. 11A depicts a top view of an exemplary layer including a square field emission structure.
FIG. 11B depicts an oblique projection of the exemplary layer of FIG. 11A.
FIG. 11C depicts an exemplary screw.
FIG. 11D depicts an exemplary axle.
FIG. 11E depicts an exemplary stacked field emission system.
FIG. 11F depicts six of the stacked field emission systems of FIG. 11E arranged to produce a composite field emission.
FIG. 11G depicts three of the stacked field emission systems of FIG. 11E in an alternative arrangement.
FIG. 11H depicts four of the stacked field emission systems of FIG. 11E in yet another alternative arrangement.

FIG. 11A depicts a top view of an exemplary layer 700 including a square field emission structure 702 having a hole 104 and an optional outer substrate 704. FIG. 11B depicts an oblique projection of the exemplary layer of FIG. 11A. FIG. 11C depicts an exemplary constraining screw 212. FIG. 11D depicts an exemplary axle 202. FIG. 11E depicts an exemplary stacked field emission system 706 including two layers 700*a* 700*b* like the layer 700 depicted in FIG. 11A having been attached using an axle 202 and two constraining screws 212. FIG. 11F depicts six of the stacked field emission systems 706*a*-706*f* of FIG. 7E arranged to produce a composite field emission. One skilled in the art will recognize that such systems might be attached together by many different methods such as using adhesives or a top plate screwed into them, which might also include one or more handles, or some other mechanism such as a lever. FIG. 11G depicts three of the stacked field emission systems 706*a*-706*c* of FIG. 11E in an alternative arrangement. In FIG. 11G, the number of layers in a composite system is determined by the number of systems stacked on top of each other and the number of layers in each individual stack, which need not be the same number. FIG. 11H depicts four of the stacked field emission systems 706*a*-706*d* of FIG. 11E in yet another alternative arrangement. As seen, the field emissions of the various stacks may be directed in different directions. Moreover, such an orientation might enable an object to be surrounded by such field emissions causing it to have a desired behavior, for example, hovering.

The examples provided previously assumed field emission vectors of the emission sources are perpendicular to the surface of the field emission structure layers. However, such vector orientation is not required to practice the invention. Generally, composite field emission structures can be produced from multiple field emission structures having different field emission vector alignments other than perpendicular to the surface of the field emission structure. Under this arrangement, the alignment of field emission structure layers or portions of layers would correspond to relative positions that take into account the angles of the vectors. FIGS. 12A-12F involve composite field emission structures comprising multiple field emission structures having field emission vectors that are perpendicular and non-perpendicular to the surface where it assumed that the field emission domains remain oriented with the direction of magnetization.

Figures 12A, 12B, 12C, 12D, 12E, 12F:
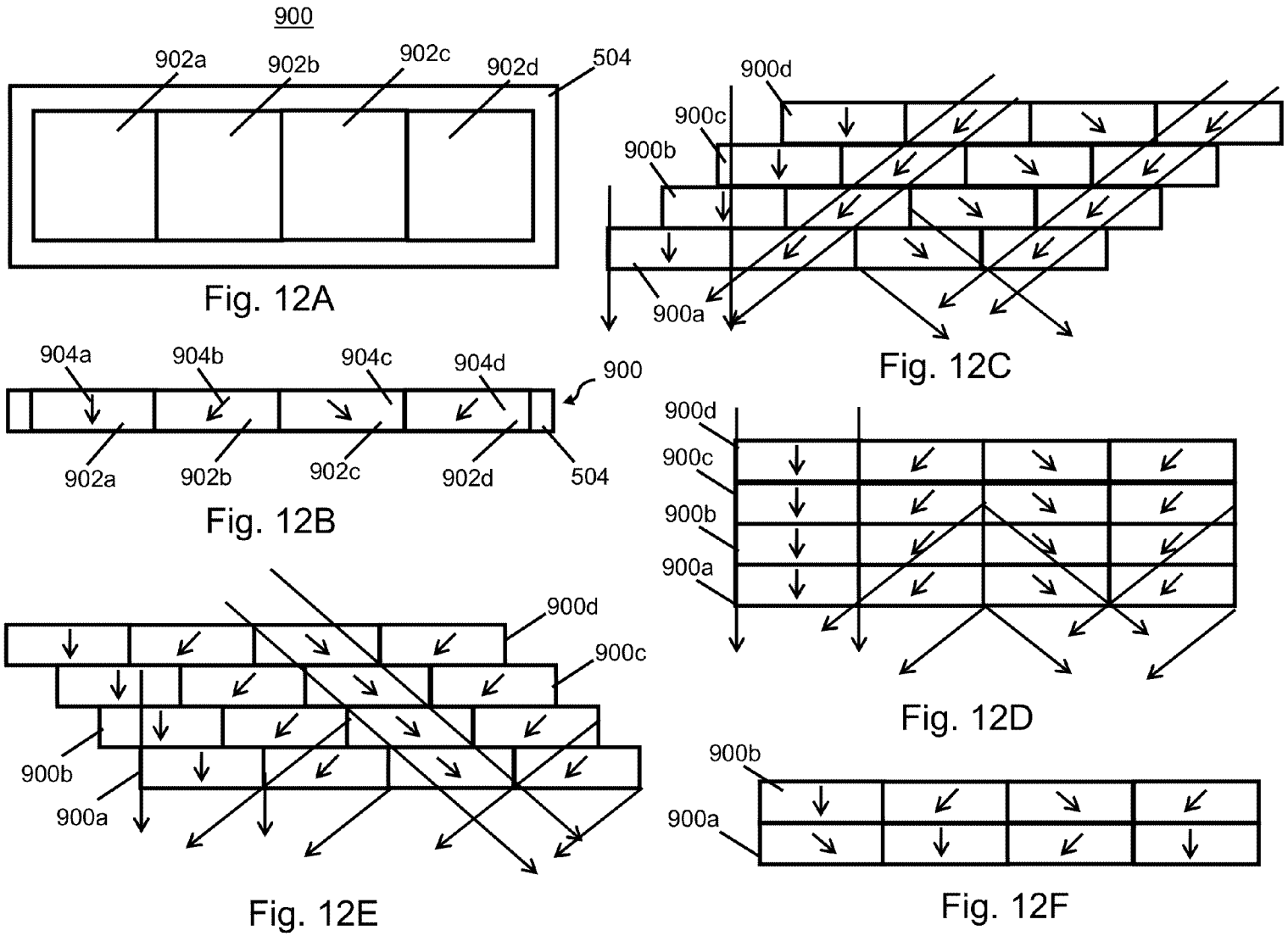
FIG. 12A depicts a plan view of an exemplary layer including a rectangular composite field emission structure.
FIG. 12B depicts a side view of the exemplary layer of FIG. 12A.
FIGS. 12C-12E depict alternative alignments of a stack of four layers each having the same coding and the vector alignments depicted in FIG. 12B.
FIG. 12F depicts stacking of two different composite field emission structures.

FIG. 12A depicts a plan view of an exemplary layer 900 including a rectangular composite field emission structure 902 including four different square field emission structures 902*a*-902*d* having field emission sources with the same coding but with three different field emission vector alignments, and an optional outer substrate 504.

FIG. 12B depicts a side view of the exemplary layer 900 of FIG. 12A having four field emission structures 902*a*-902*d* having the same coding but having different vector alignments 904*a*-904*d*. One skilled in the art will recognize that they could each have different coding or a given field emission structure 902*a*-902*d* might have uniform coding (i.e., be a conventional magnet).

FIGS. 12C-12E depict alternative alignments of a stack of four layers 900*a*-900*d* each having the same coding and having the vector alignments 904*a*-904*d* depicted in FIG. 12B. As shown in FIG. 12C, relative alignments of the layers can be achieved that enable field emissions to travel through all layers of the structure in the direction of vector that are non-perpendicular to the surfaces of the layers or in a direction that is perpendicular to the layers. In FIG. 12C, non-perpendicular vectors are shown aligning at an angle in two different paths through the four layers from right to left. In FIG. 12D, perpendicular vectors are aligned in one downward path while in FIG. 12E non-perpendicular vectors are shown aligning along one path through the four layers from left to right. Many different alignments producing many different vector paths through all layers are possible based on the magnetization direction. Moreover, partial paths are depicted where vectors only align for some of the layers. Many different configurations are possible to include configurable Halbach arrays.

FIG. 12F depicts stacking of two layers 900*a* 900*b* including two different composite field emission structures having entirely different vector direction arrangements. Generally, stacks can include all sorts of layers having different vector direction arrangements.

Figure 13A:
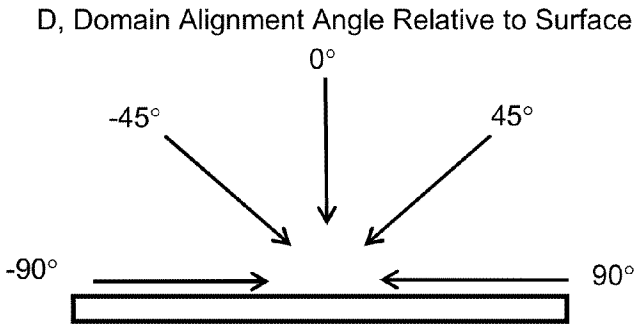
FIG. 13A depicts different magnetic domain alignment angles relative to a surface of a magnetizable material.
Figure 13B:
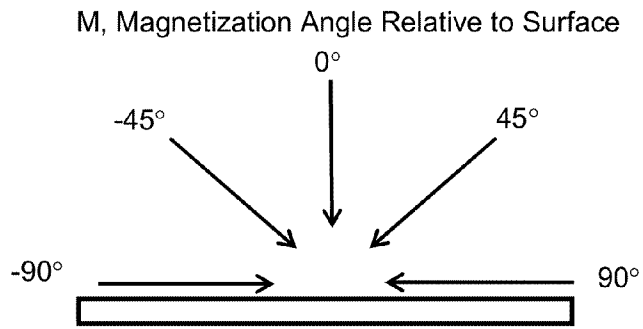
FIG. 13B depicts different magnetization angles relative to a surface of a magnetizable material.
Figure 13C:
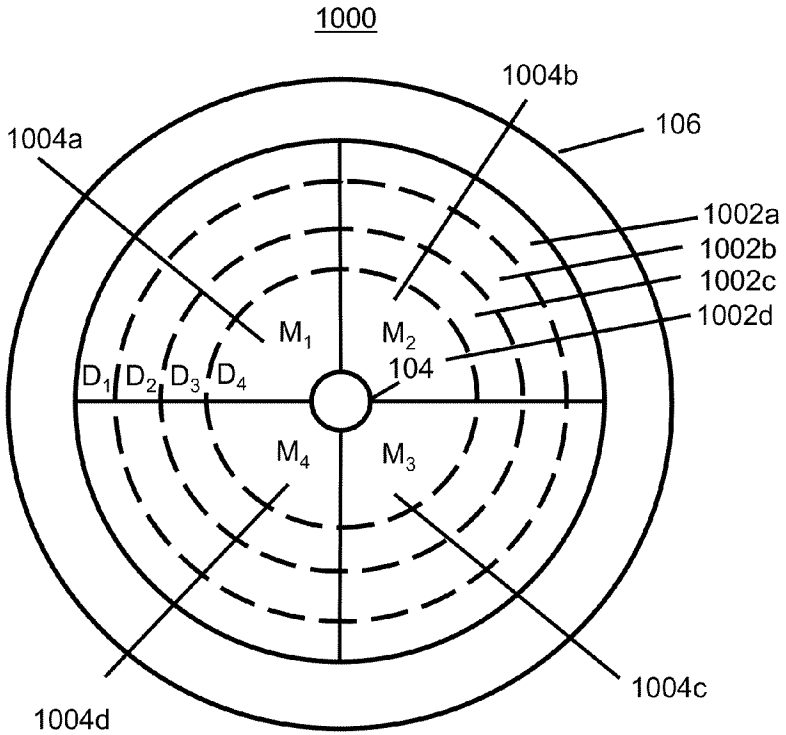
FIG. 13C depicts an exemplary round composite field emission structure.

FIG. 13A depicts different magnetic domain alignment angles D relative to a surface of a magnetizable material. FIG. 13B depicts different magnetization angles M relative to a surface of a magnetizable material. FIG. 13C depicts an exemplary layer 1000 including a round composite magnetic field emission structure 1002 including four concentric rings 1002*a*-1002*d* about a hole 104 where the four concentric rings 1002*a*-1002*d* have four different magnetic domain alignments $D_1$-$D_4$ and the four rings 1002*a*-1002*d* are subdivided into four quarters 1004*a*-1004*d* having four different magnetization angles $M_1$-$M_4$.

Figure 14:
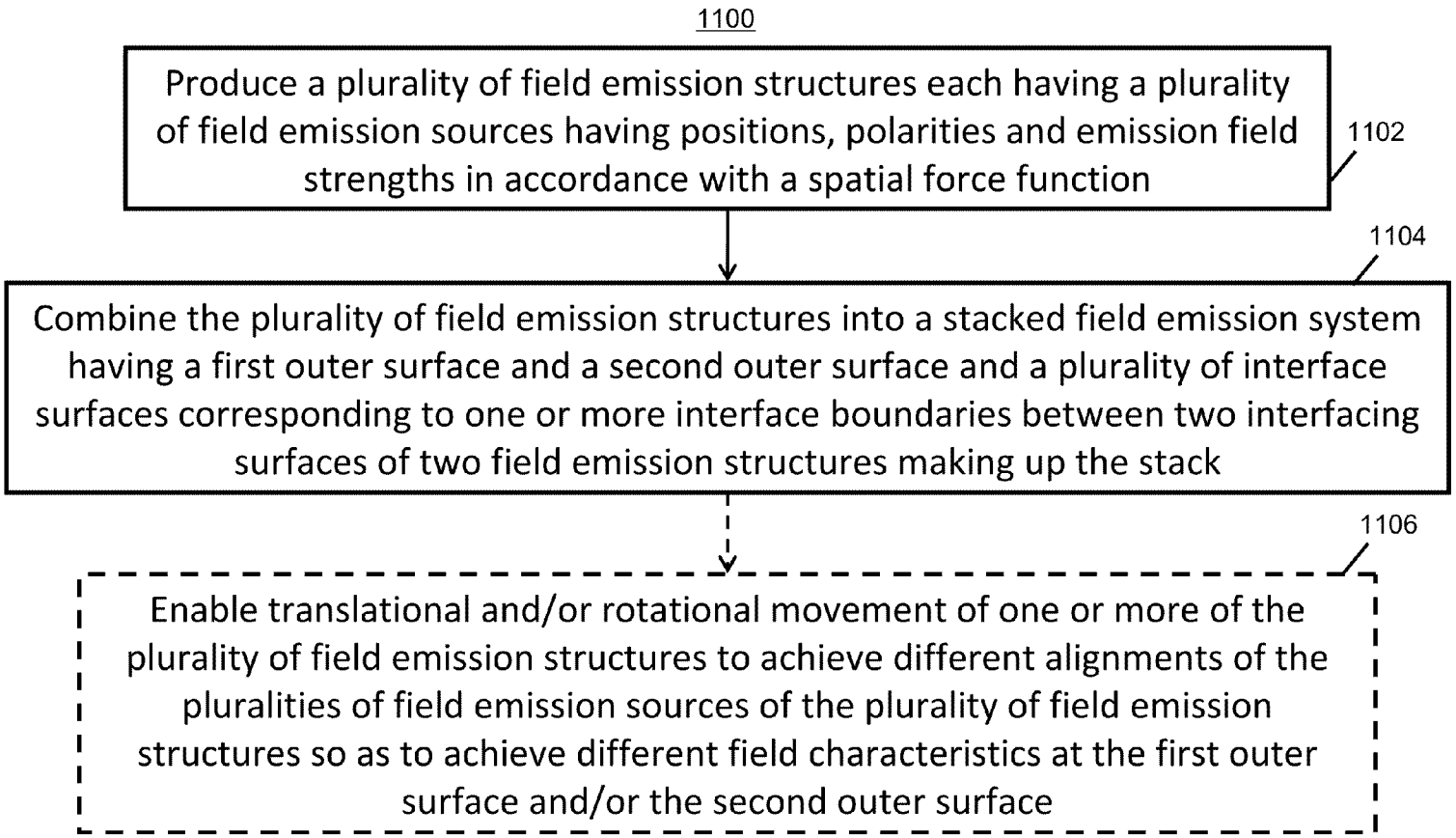
FIG. 14 depicts an exemplary method for producing a stacked field emission system.

FIG. 14 depicts an exemplary method 1100 for producing a stacked field emission system that includes two steps and an optional step. Referring to FIG. 14, method 1100 includes the first step 1102 of producing a plurality of field emission structures each having a plurality of field emission sources having positions, polarities, and emission field strengths in accordance with a spatial force function. Method 1100 also includes a second step 1104 of combining the plurality of field emission structures into a stacked field emission system having a first outer surface and a second outer surface and a plurality of interface surfaces corresponding to one or more interface boundaries between two interfacing surfaces of two field emission structures making up the stack. Method 1100 may also include an optional step 1106 of enabling translational and/or rotational movement of one or more of the plurality of field emission structures to achieve different alignments of the pluralities of field emission sources of the plurality of field emission structures so as to achieve different field characteristics at the first outer surface and/or the second outer surface.

In accordance with another embodiment of the invention, different codes can be used to define different field emission structures in the stack.

In accordance with another embodiment of the invention, a conventional magnet can be used in place of a field emission structure as one of the layers of the stack.

Many variations are possible to practice the invention including use of spacers (e.g., plastic spacers) between layers to prevent them from contacting and use of metallic layers (e.g., stainless steel) between layers or on the outside of the stack. Various methods can also be used to reduce friction between layers such as using Teflon tape or ferrofluid or graphite.

While particular embodiments of the invention have been described, it will be understood, however, that the invention is not limited thereto, since modifications may be made by those skilled in the art, particularly in light of the foregoing teachings.

The invention claimed is:

1. A stacked field emission system having an outer surface, comprising:

at least three field emission structure layers having a stacked relationship that defines a field characteristic of the outer surface;

a constraining mechanism for maintaining said at least three field emission structure layers in said stacked relationship by holding the at least three field emission structure layers such that a plurality of interface surfaces of the at least three field emission structure layers correspond to a plurality of interface boundaries between adjacent field emission structure layers; wherein each of said at least three field emission structure layers comprises a plurality of field emission sources having positions, polarities, and field strengths in accordance with a spatial force function that corresponds to a relative alignment of said at least three field emission structure layers in the stacked relationship; wherein each field emission source of said at least three field emission structure layers has one of a first vector direction or a second vector direction, said second vector direction being opposite said first vector direction, said first vector direction and said second vector direction corresponding to a magnetization angle relative to said plurality of interface boundaries; wherein vectors of field emission sources of at least two interfacing field emission structure layers can be aligned to produce at least one vector path that enables field emissions to travel through the at least two interfacing field emission structure layers; wherein vectors of field emission sources of at least two interfacing field emission structure layers can be misaligned resulting in vector cancellation; and wherein a movement of at least one of said at least three field emission structures varies the field characteristics of the outer surface.

2. The stacked field emission system of claim 1, wherein said field emission sources of said at least three field emission structure layers have polarities in accordance with at least one code.

3. The stacked field emission system of claim 2, wherein said field emission sources of said at least three field emission structure layers have polarities in accordance with the same code.

4. The stacked field emission system of claim 1, wherein said at least three field emission structure layers can be aligned to achieve correlation of all of said field emission sources.

5. The stacked field emission system of claim 1, wherein the stacked relationship comprises at least one of a vertically stacked relationship, a horizontally stacked relationship, or a concentrically stacked relationship.

6. The stacked field emission system of claim 1, wherein the movement comprises at least one of rotational movement or translational movement.

7. The stacked field emission system of claim 1, wherein the plurality of emission sources comprise emission sources having field emission vectors substantially perpendicular to an interface surface of a field emission structure layer.

8. The stacked field emission system of claim 1, wherein the plurality of emission sources comprise emission sources having field emission vectors not perpendicular to an interface surface of a field emission structure layer.

9. The stacked field emission system of claim 1, wherein the plurality of emission sources comprises a Halbach array.

* * * * *